US005332532A

United States Patent [19]

Kaye et al.

[11] Patent Number: 5,332,532

[45] Date of Patent: Jul. 26, 1994

[54] METHOD FOR DISPOSING OF RADIOACTIVELY LABELED ANIMAL CARCASSES

[75] Inventors: Gordon I. Kaye, Troy; Peter B. Weber, Delmar, both of N.Y.

[73] Assignee: Waste Reduction by Waste Reduction, Inc., Troy, N.Y.

[21] Appl. No.: 988,209

[22] Filed: Dec. 9, 1992

[51] Int. Cl.[5] ..... G21F 9/16

[52] U.S. Cl. ..... 588/16; 588/17

[58] Field of Search ..... 252/626

[56] References Cited

U.S. PATENT DOCUMENTS

| | | | |
|---|---|---|---|
| 1,974,554 | 4/1933 | Ziegler | 260/119 |
| 3,047,434 | 7/1962 | Bulat | 252/626 |
| 3,764,553 | 10/1973 | Kirby | 252/301.1 |
| 3,776,856 | 12/1973 | Scheffler et al. | 252/626 |
| 3,887,717 | 6/1975 | Pfeiffer et al. | 426/264 |
| 4,162,298 | 7/1979 | Holladay et al. | 423/230 |
| 4,223,448 | 9/1980 | Saito et al. | 34/4 |
| 4,349,453 | 9/1982 | Brugere et al. | 252/627 |
| 4,388,204 | 6/1983 | Dimond et al. | 252/98 |
| 4,417,909 | 11/1983 | Weltmer, Jr. | 62/12 |
| 4,437,999 | 3/1984 | Mayne | 210/748 |
| 4,492,649 | 1/1985 | Cheh et al. | 252/630 |
| 4,778,627 | 10/1988 | Doan | 252/631 |
| 4,980,132 | 12/1990 | Stinson et al. | 422/159 |
| 5,066,597 | 11/1991 | Stinson et al. | 435/311 |
| 5,082,603 | 1/1992 | Horie et al. | 252/628 |

FOREIGN PATENT DOCUMENTS 82696 2/1928 Japan .

*Primary Examiner*—Donald P. Walsh
*Assistant Examiner*—Ngoclan T. Mai
*Attorney, Agent, or Firm*—Heslin & Rothenberg

[57] ABSTRACT

A method for disposing of animal tissue containing radioactive materials by producing a solution containing a substantially de minimis concentration of radioactive materials through alkaline hydrolysis and dilution of the animal tissue containing the radioactive materials followed by disposing of the de minimis solution in a sewage system or septic system. Additionally, an apparatus for practicing the above method which comprises a tank capable of forming a closed reaction vessel with a highly basic solvent therein. The apparatus further comprises a means for heating the highly basic solvent and means for filtering and removing the solution of de minimis radioactivity formed within the tank.

19 Claims, 3 Drawing Sheets

METHOD FOR DISPOSING OF RADIOACTIVELY LABELED ANIMAL CARCASSES

TECHNICAL FIELD

The present invention relates to the field of radioactive waste disposal, more particularly, to a method and apparatus for safely disposing of animal carcasses and animal tissue containing radioactive materials used in labeling processes.

DESCRIPTION OF THE PRIOR ART

Radioactive materials are commonly used as a tool to enhance chemical, bio-chemical, pharmaceutical, biomedical and biological research. It is common to label drugs or chemical compounds with $^{14}C$, $^{3}H$, or other radioisotopes in order to study efficiently and accurately where these compounds are metabolized and incorporated within the body. This type of radioactive labeling is commonly employed by medical schools, universities, pharmaceutical companies, toxicology labs, health labs, cosmetic manufacturers, and general biomedical and biological research institutions. The labeling of chemical compounds with radioactive isotopes is an essential tool in biomedical research and in the development of new therapeutic compounds. The drawback in utilizing radioactive labeling as a research tool is that it inevitably produces an animal carcass or animal tissue containing some amount of radioisotopes, requiring the use of expensive and cumbersome disposal and/or containment procedures for the entire carcass.

Animal carcasses containing compounds labelled with $^{14}C$ or $^{3}H$ are classified as low-level radioactive waste (LLRW). Because state and federal guidelines regulate the disposal of LLRW, special precautions must be followed in disposing of these animal carcasses.

Currently, the two methods commonly used in disposing of this type of waste are incineration and burial. Presently Federal law allows for incineration only when the animal carcass contains a radioisotope concentration below 0.05 microcuries/gram. However, even when radioisotope concentrations are below this level, incineration may be further limited by state and local agencies. When the levels of radioactivity in the animal carcasses are below acceptable de minimis levels as defined by Federal, state and local authorities, disposal is not subject to additional regulation. To complicate matters still further, incineration of radioactive animal carcasses at any level is not available at all in some jurisdictions such as the major metropolitan areas of New York City, San Francisco and Chicago. Nonetheless, the general process of incineration itself, even when no radioactive materials are involved is subject to additional regulations, such as those requiring a direct license from a state or local environmental agency. Additionally, future increases in the requirements for incinerator designs and function under clean air regulations put in doubt the continued availability of incineration as a method of disposing of animal carcasses classified as LLRW.

Presently, the only real alternative to incineration is burying the carcasses in a licensed low-level radioactive waste disposal facility. This method entails the packing of the entire carcasses in lime and adsorbents, repacking them in special 55-gallon drums and shipping the drums to the low-level radioactive waste site. Currently there are only two such sites in the United States, located at Hanford, Wash.; and Barnwell, S.C. Due to the limited number of land burial sites currently operating in the United States, it is extremely costly to dispose of any radioactive waste by this method and is disproportionately costly for animal carcasses containing low level radioactive waste due to the size and weight of the carcass. Such disproportionality in cost becomes patently clear when one considers that a carcass containing only trace amounts of LLRW material is charged the same fee as if the entire carcass were low level radioactive waste. Due to the extremely high cost associated with land burial and the limitations on access to the current land burial sites, the feasibility of land burial as a method of disposing of animal carcasses classified as LLRW remains in doubt.

It is known in the art that low levels of certain radioactive waste is disposed of without government regulation of waste form, packaging and monitoring. Such a procedure has been utilized, for example, in the disposal of radioactive waste generated by many patients undergoing treatments for cancer. Today, a common method of treating cancer in such patients is by radiation therapy which often involves the absorption of radioactive compounds. The radioactively tagged compounds are metabolized and incorporated within the patient's body. Many of these radioactive compounds eventually leave the body through fecal and urinary excretions. These excretions will contain small amounts of radioactive material. However, this radioactive material is disposed of through the general sewage system because the de minimis level of the radioactive materials as discharged by the body into the sewer system is sufficiently diluted such that it no longer poses any hazard to public health and safety. This process is well within the state and Federal disposal regulations for LLRW disposal. This method of disposal has heretofore been limited to the waste produced by the treated human patients due to its inherent affinity for disposal within sewage systems. However, LLRW contained in animal remains are not readily capable of disposal through such means.

It is known in the art that substances containing keratin, such as hair and nails may be dissolved by means of acid or alkaline hydrolysis, as disclosed in U.S. Pat. No. 1,974,554 issued to Ziegler. Although it is known in the art that hydrolysis of proteins containing keratin may be carried out with alkaline solvents there is no suggestion in the prior art that such hydrolysis may be utilized on proteins contaminated with radioactive materials. Further, the prior art fails to teach any reason for utilizing alkaline hydrolysis of proteins containing radioactive material.

Of the known methods of disposing of LLRW, each faces an indeterminable future under the ever changing breadth of the environmental laws. Furthermore each is extremely costly, putting an unneeded drain on an already strained research budget of universities and other research institutions. Thus, a need persists for a method and apparatus disposing of animal carcasses containing small amounts of radioactive compounds safely and inexpensively.

SUMMARY OF INVENTION

This need is satisfied and the limitations and expenses of the prior art overcome, in accordance with the principles of the present invention, by providing a method for producing a safely disposable solution from animal tissue containing radioactive materials. This method comprises the steps of providing a highly basic solvent, immersing the animal tissue containing the radioactive materials within the highly basic solvent and heating the highly basic solvent. The animal tissue containing the radioactive materials is allowed to remain within the highly basic solvent until substantially digested, thereby forming a solution containing a substantially de minimis concentration of radioactive materials.

This invention also provides a method as described above which further includes disposing of the de minimis solution.

This invention also provides for the disposal of said de minimis solution into a disposal means such as a sanitary sewer or septic system.

This invention further provides an apparatus for producing a safely disposable solution containing a de minimis concentration of radioactive materials from animal tissue containing radioactive materials. The apparatus comprises a tank that contains a highly basic solvent therein. The apparatus further contains a heating means that is capable of heating the highly basic solvent, a filtering means and a means for removing the solution of de minimis radioactivity formed within the tank.

The apparatus also provides an alternative embodiment comprising a plurality of tanks.

Accordingly, it is a principle object of this invention to provide a method and apparatus for disposing safely of animal carcasses containing small amounts of radioactive compounds.

One significant feature of this invention is that it safely disposes of the LLRW at significantly less expense to the research institution without harming or increasing the risk of harm to the environment.

One advantage of this invention is that the method and apparatus may be utilized without geographic limitations, notwithstanding existing governmental regulations such as those that exist in certain metropolitan areas such as New York, Chicago and San Francisco.

Another advantage of this invention is that it preserves the ever shrinking area available in the land burial sites for more hazardous radioactive waste and dispenses with the need of transporting the LLRW over significant distances.

DETAILED DESCRIPTION OF THE INVENTION

Figure 1:
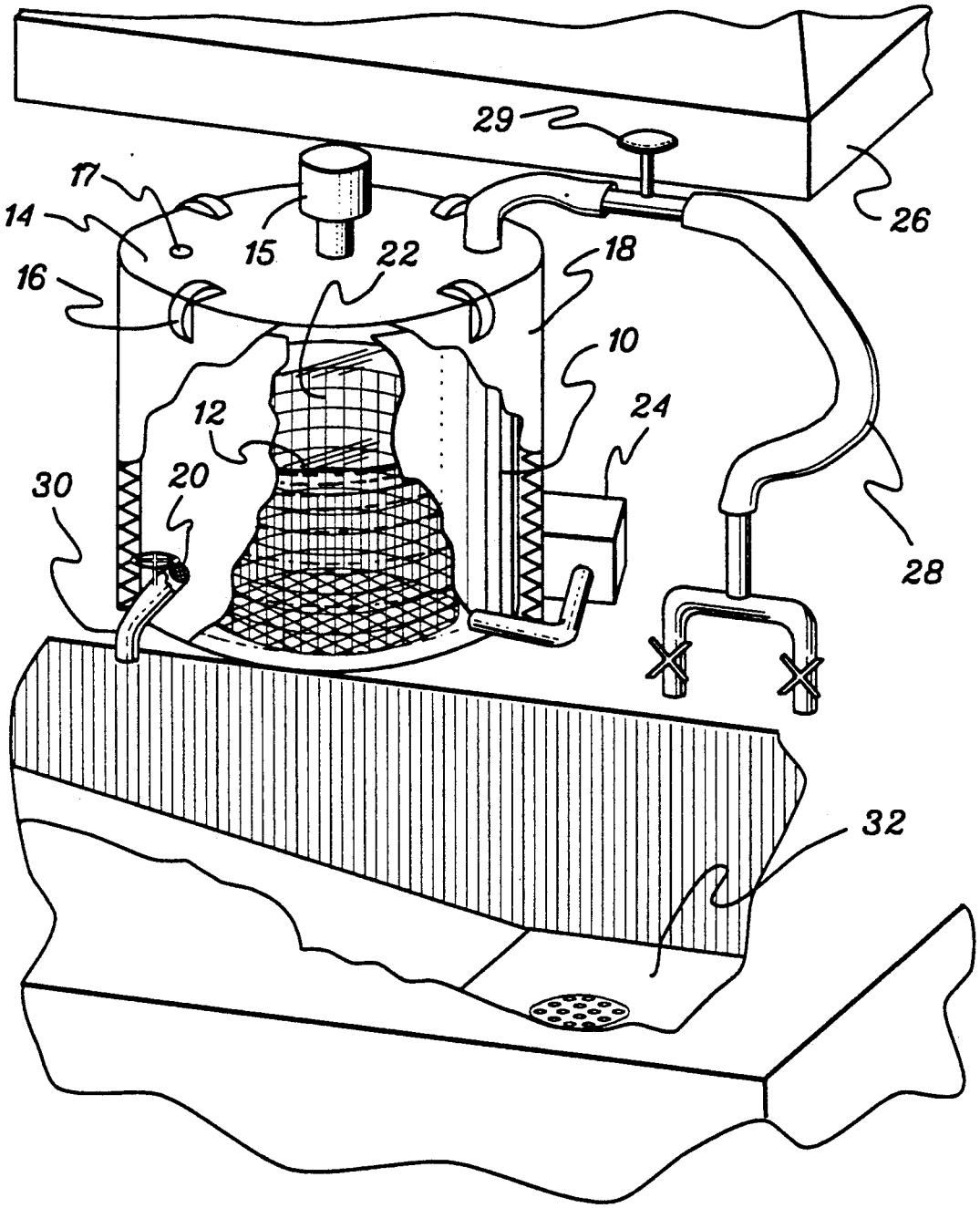
FIG. 1 shows a partial cut-away elevated view of an embodiment of the inventive apparatus utilizing one tank.

This invention involves a method and apparatus for disposing of animal tissue or animal carcasses containing radioactive materials safely and is designed and intended to comply with all Federal, state and local laws or regulations applicable to disposal of LLRW presently in existence.

The method comprises the steps of providing a highly basic solvent and immersing animal carcasses and/or tissue containing radioactive material within said highly basic solvent. The highly basic solvent is heated and the animal carcasses and/or tissue containing radioactive material is allowed to remain within the highly basic solvent until substantially digested, thereby forming a solution of de minimis radioactivity that may be directly disposed of via a sanitary sewage system.

As stated above, animal tissue or carcasses incorporate radioactive elements when research is conducted utilizing chemical compounds labeled with $^{14}C$, $^{3}H$ or other radioisotopes. Once these tagged compounds enter the animal's body they are metabolized and incorporated into the animal's tissues. Examples of lab animals commonly used in biological or biomedical research are: rats, mice, rabbits, sheep, pigs, chickens, dogs and others. On completion of the necessary studies, the researcher is left with animal tissue and/or an animal carcass that contains the radioactive labeled compounds and their metabolites. This causes the animal tissue and/or carcass to be classified as low-level radioactive biological waste as defined by 10 CFR §61.

Regardless of the level of radioactivity, it is necessary to dispose of the entire animal tissue and/or carcass because the body tissue of deceased lab animals begins to decompose immediately after death. Thus, animal remains must be dealt with soon after the research is completed in order to avoid the creation of noxious odors and other health hazards. However, freezing of the animal tissue or carcasses effectively prevents decomposition and the creation of noxious odors and health hazards. Thus, when it is not economical or technically feasible to dispose of the animal carcasses on a daily basis, the animal remains may be frozen and stored in that condition until an appropriate time or number of animals for disposal is acquired. Temporary storage of the animal carcasses by freezing may be accomplished by any refrigeration means capable of maintaining a temperature of 0° Celsius or below and capable of storing the amount of animal carcasses desired. For example, a household or commercial freezer capable of freezing meat could adequately freeze the animal carcasses during storage.

When the researcher is ready to dispose of the animal remains, the remains are completely immersed in a highly basic solvent. Preferably, this solvent should have a pH of at least about 13 and it may be comprised of a mixture of water and an alkali metal hydroxide or alkaline earth-metal hydroxide. However, a solution of NaOH or KOH is the preferred solvent. An example of such a suitable highly basic solvent may consist of a 1.0 molar to 2.5 molar solution of NaOH in water, or approximately 4%–10% sodium hydroxide (by weight) in water. The animal remains should be immersed in enough highly basic solvent such that the animal remains may be completely digested. One ratio assuring excess base to carry out the digestion of the animal tissue to completion is a 1:10 ratio of alkali metal hydroxide to wet tissue weight. A further expression of this ratio is 40 kilograms of NaOH dissolved in 900 liters of water added to 100 kilograms dry weight protein or 40 Kg of NaOH in 500 l $H_2O$ added to 500 kilograms fresh or frozen animal by weight. These ratios are given only as instruction as how to conduct the method stated herein and not to limit the nature of the invention; one using the method described herein may find ratios more economical and exact as the invention is practiced.

After the animal remains have been immersed within the highly basic solvent, it is most preferable to allow the reaction to proceed in a closed reaction vessel. Reducing the amount of $CO_2$ available to the reaction is beneficial in order to maintain the ideal rate and stoichiometry of the reaction. This may be done by simply removing or limiting any contact that the highly basic solvent has with the environment. If the reaction is occurring within a tank, placing a suitable cover on top of the tank would suffice.

If the reaction between the animal carcass and highly basic solvent were allowed to proceed at its natural rate, it may take an impractical amount of time. Therefore, it is advantageous to increase the reaction rate beyond its natural progression. One way to speed up the reaction process is to heat the highly basic solvent, preferably to temperatures of 80°-130° C. The most preferable temperature range is 100° C.-120° C. Preferably, increased atmospheric pressures up to 25 PSI above 1 atmosphere are to be used. Conducting the reaction in a sealed vessel under increased atmospheric pressure also reduces the reaction time needed to completely digest the animal tissue. Furthermore, addition of detergents to a concentration of up to 1% to the highly basic solvent, examples being sodium lauryl sulfate or deoxycholate, may be added to increase the rate of digestion. It should also be noted that addition of detergents to the highly basic solvent also has the advantage of dispersing non-saponifiable lipids, and aiding in the sterilization of biological materials.

In addition, butchering of large animal carcasses, cutting small animal carcasses in half, or opening the abdominal and thoracic cavities of intact animals prior to immersion within the highly basic solvent reduces the reaction time by making more surface area of the animal tissue accessible to the highly basic solvent. Still another method capable of reducing the reaction time is provided by supplying an excess of fresh highly basic solvent continuously onto the surface of the carcasses and tissue. This may be accomplished by agitating or stirring the solvent or moving either the highly basic solvent or the animal carcasses.

The reaction rate will ultimately depend on specific variables such as: the temperature of the solvent, pressure in the reaction vessels, physical size of the carcasses or tissue and ratio of animal remains to the volume of the highly basic solvent. As the reaction rate will vary, the time that the animal remains must remain immersed in the highly basic solvent will also vary. However, regardless of the reaction rate, the animal carcasses should remain immersed within the highly basic solvent until substantially digested. Leaving the animal carcasses within the highly basic solution until complete digestion is achieved will also help produce a sterile solution.

Once the animal tissue has been completely digested, two types of solid debris often remain. The first type of debris consists of rubber or plastic that the lab animal may have ingested and debris remaining from experimental or surgical procedures, such as surgical clips, sutures, glass, and bits of plastic or paper. Solid items such as these never incorporate the radioactive isotopes nor are they considered biomedical waste. Therefore, this type of debris may simply be disposed of as ordinary sterile solid waste after being isolated from the solution and washed. The second type of solid debris remaining undissolved includes inorganic portions of the animal's skeletal structure. Unless a radioisotope capable of incorporation into the inorganic portion of bones and teeth is used, such as $^{32}p$ and $^{45}Ca$, the inorganic component of the skeletal remains will not contain the radioactive isotope and may be disposed of as solid sterile waste. The skeletal remains, when removed from the highly basic solvent and washed, are extremely friable and may be easily crushed. In fact, they are so friable that they may be crushed to form a disposable powder by such relatively simple means, as rubbing between one's fingers.

If a researcher wishes to dispose of the skeletal remains along with the animal tissue out of convenience or because the inorganic skeletal remains may contain radioisotopes, it is necessary to add approximately two percent ethylenediamine tetraacetic acid (EDTA) to the highly basic solvent. Addition of this chelating agent will cause the calcium phosphate salts within the bones and teeth to be completely dissolved.

After the animal remains have been substantially digested within the highly basic solvent and the solid debris removed, the solution comprises not only a diluted concentration of radioactive materials yielding a de minimis or substantially de minimis concentration of radioactive materials, but also an alkaline mixture of alkali metal salts, amino acids and peptides, sugar acids, nucleotides, small peptides, fatty acids from lipids, phosphates from lipid and nucleic acid breakdown, soluble calcium salts, pigments, sugars, sugar alcohols, hydrocarbons and inorganic acids derived from the electrolytes normally within solution in body fluids. These non-radioactive by-products are identical to those released in vast amounts from cooking leftovers and waste from all commercial and household kitchens. Thus, the solution contains compounds that are non-toxic and biodegradable by bacteria or fungi found in soil and sewage treatment systems, and a very dilute amount of radioactive material.

Because the solution at the end of the reaction process contains only non-toxic biodegradable materials and an already diluted small amount of radioactive compounds, dilution of the solution may not be required for disposal. Dilution will be required only if, after testing the final solution for radioactivity, the solution fails to meet Federal and state de minimis disposal regulations. The solution may be diluted by adding excess water to the reaction vessel or disposal means before it is discharged or as it is being discharged. For the most common uses of $^{14}C$ and $^{3}H$ in radioactive labelling, dilution of the solution created within the reaction vessel with an equal volume of water reduces the radioactivity well below the Federal and local definitions of de minimis. The solution is then well within the level of radioactivity that is safely disposable as sanitary sewage. Dilution may also be accomplished by one skilled in the art by calculation of the dilution of this specific unit of waste volume by the entire waste volume of the institution or manufacturing plant.

This solution of de minimis radioactivity may be safely disposed of utilizing methods commonly used to dispose of everyday nontoxic and biodegradable substances. It is entirely safe to dispose of this solution of de minimis radioactivity using disposal means such as septic tanks, sewage systems, and other disposal means appropriate for the disposal of these simple biodegradable compounds.

EXAMPLE I

A basic solution of 4 l of water, 1 l of chlorine bleach and 1 l 44% NaOH (7.33% NaOH of the total 6 l) was placed in a metal can on a hot plate. Three (3) frozen rats, whole without cuts in the skin, with a collective weight of 838 g were placed in a wire basket and immersed within the basic solution. The wire basket was rotated with an overhead stirrer. After an elapsed time of 50 minutes, the temperature had reached 45° C. After 1 hour 12 minutes it reached 55° C. At 2 hours 15 minutes only small pieces of the first three (3) rats remained and at this time six (6) rat halves weighing 898 g were added to the basic solution now at 80° C. At 4 hours 55 minutes all the rats had completely dissolved, at which point another 666 g of rat carcasses in the form of four (4) rat halves were added to the solution. By 8 hours 30 minutes there was no material left in the wire basket; except for a small amount of large bones and incisor teeth, all the rat carcasses had completely dissolved.

EXAMPLE II

One frozen mouse weighing approximately 40 g, was placed in a 46° C. solution of 100 ml of 44% w/w NaOH and 300 ml chlorine bleach with a magnetic stirrer in a 1000 ml jacketed and covered beaker. After 30 minutes the initially frozen carcass had completely thawed and disintegrated into small individual pieces. After 1 hour 50 minutes the first mouse had completely dissolved except for the bones and several specs of dark material. At this point another 100 ml of chlorine bleach was added and the stirring continued. At 1 hour 30 minutes another 2 mice comprising 70.3 g were added to the solution. At 2 hours 35 minutes all 3 mice had completely dissolved at which point 2 more mice, together at 72 g, were added to the solution. At 3 hr. 50 min. all the mice had completely dissolved and 4 g of disodium - EDTA was added to the solution. The next day, the homogeneous solution was filtered through a 40 mesh-/inch stainless steel screen; except for some bones and teeth, everything passed through the filter.

EXAMPLE III

A basic solution is created by dissolving 4 Kg of NaOH in 50 l of water in a tank. 50 Kg of frozen rats carcasses containing radioactive compounds is added to the basic solution, thereby forming a reaction mixture. An air-tight cover is placed over the top of the tank. The reaction mixture is heated to a temperature of 100° C. using a water jacket surrounding the tank. The basic solvent is circulated through pumps connected to the tank. The rat carcasses are allowed to remain immersed within the basic solvent for 2 to 16 hours, more preferably for 8–10 hours. The skeletal remains and solid debris are removed washed and disposed of as non-hazardous solid waste. The now homogeneous solution within the tank is diluted with 50 l of water in order to form a solution with de minimis radioactivity.

The disclosed invention also includes an apparatus for producing a safely disposable solution of de minimis radioactivity from animal tissue containing radioactive material. As can be seen in reference to FIG. 1, such an apparatus comprises the following elements: a sealable tank 10 with a highly basic solvent 12 therein, a permeable container 22 for storing radioactive animal carcasses, a water supply means 28, a filtering means 20, a pressurizing and venting means 15 and a disposal means 32.

The preferred apparatus comprises a singular tank or vessel capable of containing a solution. The tank must be made of a material that is capable of withstanding the pH levels, temperatures and pressures utilized in this process, an example being stainless steel.

The reaction between the highly basic solvent 12 and the animal carcasses takes place within a tank 10 that may be open or sealable. However, it is preferable for the reaction to occur within a closed reaction vessel in order to prevent $CO_2$ from the atmosphere from entering the reaction path. Thus, the tank 10 preferably has a sealing means 14 capable of withstanding the chemicals, temperatures and pressures utilized in this process, an example being stainless steel. When only one atmosphere of pressure is utilized, it is possible for the sealing means 14 to simply comprise a fitted cover. However, when increased pressure is utilized, the sealing means 14 must be more complex, being pressure and air tight. This may be accomplished through the use of an alkali resistant gasket and a cover sealed to the tank with clamps 16. A pressurizing means 15 may be fitted to sealed tank 10 in order to increase the pressure therein. Furthermore, in an alternative embodiment the sealing means 14 may also contain a pressure gauge to monitor the reaction vessel, adjustable safety valves, and a sampling port 17 for measurement of the pH and radioactivity of the reaction mixture. The sealing means 14 may further contain an internal water supply means, such as a sprinkler, attached to a water supply via a valved clock in order to automate the process.

As discussed above, the process requires that the highly basic solution 12 be heated in order to reduce the reaction time needed to completely dissolve the animal carcass. Therefore, a heating means 18 is necessary to heat the highly basic solvent 12. Any heating means 18 commonly known and used today for heating solutions could be utilized in this process. One example of such a heating means 18 is a stainless steel heating jacket, in which heated water or steam circulates between the walls of a double walled tank, thereby heating the solution within the tank. Alternatively, the tank 10 may be fitted with an electric heating mantle or placed upon a hot pad.

As discussed above, after the animal carcasses have been fully digested, there often remains undigested solid debris, i.e.: skeletal remains, glass or plastic. Thus, the preferred embodiment contains a filtering means 20, as shown in FIG. 1., for removing the solid debris before or during disposal of the solution containing a de minimis concentration of radioactive materials. An example of a suitable filter would be a 40 mesh/inch stainless steel screen. The filtering means 20 may be placed in combination with the removal means 30 such that the solution containing a de minimis concentration of radioactive material is filtered as it is removed from the tank 10.

Figure 2:
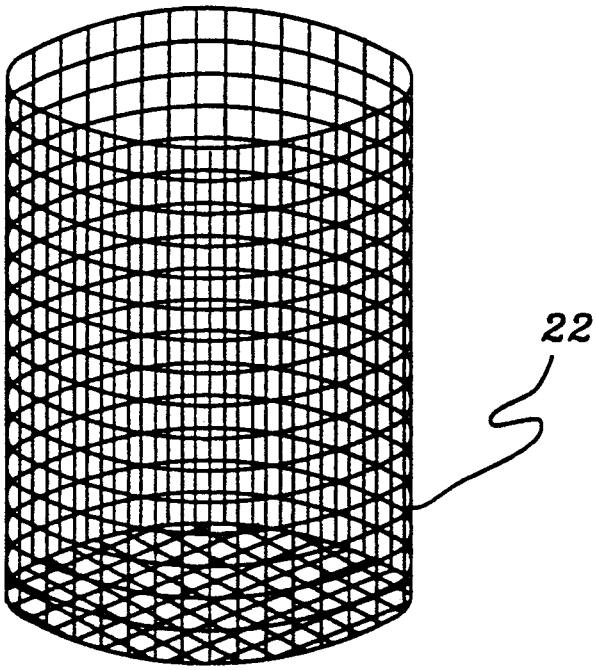
FIG. 2 shows a view of a screen mesh permeable container.
Figure 3:
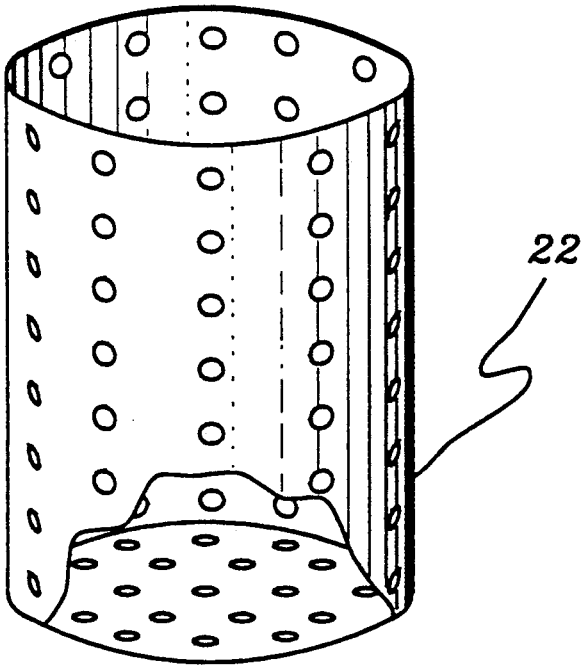
FIG. 3 shows an elevated view of a solid permeable container.
Figure 4:
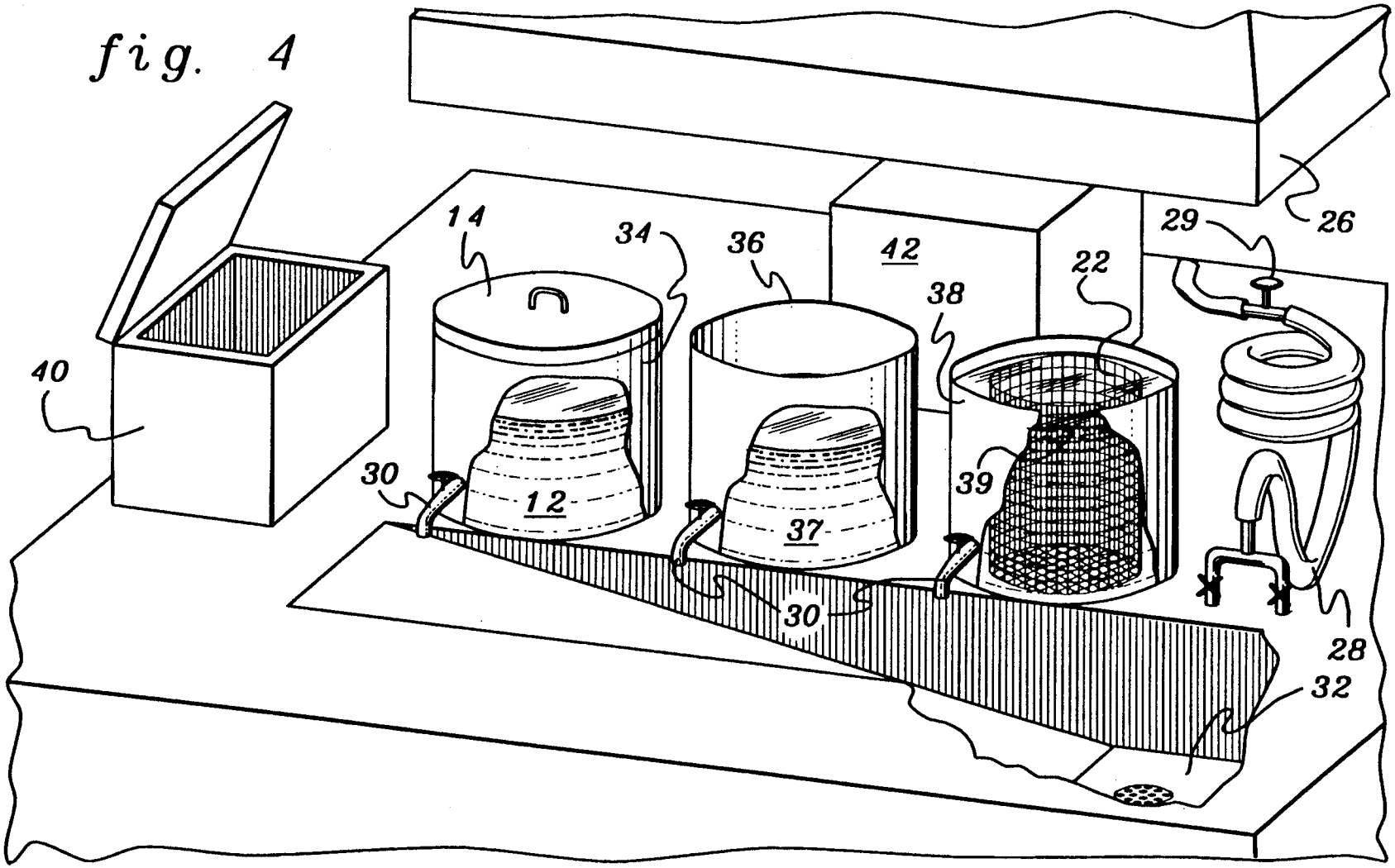
FIG. 4 shows a partial cut-away elevated view of an embodiment of the inventive apparatus utilizing a plurality of tanks.

The preferred apparatus may also additionally comprise a permeable container 22 capable of holding the animal remains. The permeable container 22 may be utilized to immerse the animal carcasses within the highly basic solvent 12. This container may also act as the filtering means and/or a means for removing the solid undigested debris. When the animal carcass is fully digested, the permeable container 22 may be removed, thereby removing the undigested solid debris remaining within the permeable container 22. The container should be made of a material capable of withstanding the pH levels, chemicals and temperatures involved in this process. In addition, the container should be permeable to liquids, small peptides and amino acids. An example of such a container can be seen in reference to FIG. 2 and FIG. 3. A container having one eighth ($\frac{1}{8}$) to one quarter ($\frac{1}{4}$) inch stainless steel screen mesh basket may suffice in practicing the method disclosed herein, such as can be seen in FIG. 2. When a large amount of animal remains is to be moved or held, the screen mesh basket should be reinforced with stainless steel bands. Alternatively, as seen in FIG. 3, the container may comprise of a solid stainless steel container with one eighth (⅛) or quarter (¼) inch holes drilled therein. Preferably, these baskets would be shaped and sized such that they could be removably fitted within of the above mentioned tank 10, with sufficient clearance to allow liquid to circulate over all surfaces of its contents. It is also possible that these containers could be sized such that they fit within the refrigeration means 40, as shown in FIG. 4, thereby reducing the work and components necessary to complete this process.

Because the natural reaction time is very slow, the preferred invention may also contain an agitating means 24 to help speed up the reaction rate by keeping the solvent or the substrate in motion while the reaction is taking place. A means for agitating or simply moving the animal remains within the highly basic solvent 12 may accomplish its task by simply moving the permeable container 22 holding the animal remains. In addition, it is also possible to accomplish the same result by circulating the highly basic solvent 12. This may be accomplished by a wide variety of means well known in the art today, examples being mechanical stirrers or pumping means. However, any pump connected to the tank 10 via piping and valves must be capable of withstanding the temperatures, chemicals and pressure involved.

An exhaustion or ventilation means 26 such as a ventilated hood may be placed over the tank 10 and be positively ventilated in order to remove any excess carbon dioxide or noxious fumes produced by performing the method disclosed herein.

Depending on the size of the tanks 10 and the amount of animal remains being digested, it may be possible to dilute the solution containing the digested animal tissue and small amount of radioactive materials directly within the tank 10 before draining said tank 10. However, not all tanks will be large enough to dilute the mixture created by the reaction. In such a case, dilution may occur simultaneously with draining of the tank 10. either case, it is necessary to have a water supply means 28, preferably with a stop valve 29. The appropriate amount of water may be added as the solution drains or is pumped from the tank 10. This may be accomplished with any means for adding water, examples being any faucet, hose or lead connected to a water supply capable of delivering the rates necessary.

Finally, the preferred apparatus may contain a means for emptying the contents 30 of the tank 10. One may simply use a drainage port and let gravity drain the solution from the tanks. Such a port would preferably be fitted with a removable screen filter 20 to retain any non-digested or inorganic materials that may have escaped from the basket during the digestion process. Alternatively, pumps may be used to drain the tanks of their contents. However, any pump utilized in this apparatus should be made of stainless steel with all seals and liners made of a material capable of withstanding strong alkaline action; an example being Teflon®. Materials such as glass, ceramics, rubber, and most synthetics should not be used due to their vulnerability to alkaline actions. The piping and valves used in the circulation of the solvent may be linked to or comprise the same piping and valves utilized in the draining and flushing of the tank. In addition, if a pump is utilized to circulate the highly basic solvent 12 this same pump may be utilized to drain the reaction mixture.

Preferred safety controls on any drainage system would include measurements of pH and radioactivity by port sampling or continuous flow analysis with input of both sets of data going to a manually or electronically controlled valving system. Specifically, manual or automated systems must receive information on the final pH and radioactivity of the solvent at the completion of the digestion process before dilution can be calculated and implemented in order to initiate discharge of the vessel.

An alternative embodiment of the present invention is shown in FIG. 4, comprising a plurality of tanks, a highly basic solution 12 within the first tank 34, a less basic solution 37 in the second tank 36, a neutral solution 39 in the third tank 38, and means for removing the solutions 30 therein. The first tank 34 may have additional modifications shown in FIG. 1, unlike the additional tanks, such as a heating means 18, a sealing means 14, an agitating means 24, and a pressurizing means 17. Since these modifications are only necessary for the tank in which the reaction actually takes place, any additional tanks would not require these modifications. Further comprising the alternative apparatus in FIG. 4 are a refrigeration means 40 for storage of animal carcasses, a means for moving the permeable container 42, a ventilation means 26, a water supply means 28 and a disposal means 32.

As can be seen from FIG. 4, it is possible for the apparatus to utilize a plurality of tanks. When more than one tank is used, it is preferable to locate the tanks in proximity to one another such as in a linear or circular series. When a single tank is used, this tank will contain the highly basic solvent 12. However, when a plurality of tanks is used, the first tank 34 in the series should contain a highly basic solvent 12 and the second tank 36 in the series should contain a solution 37 less basic than the highly basic solvent 12 within the first tank 34. Preferably the second tank 36 would contain a solution 37 having a pH of approximately 10. The solution of the second tank 36 may be comprised of one percent sodium hypochlorite; i.e., a one:five dilution of household chlorine bleach and water. The third tank 38 in the series may contain a solution 39 having a pH of approximately 7, such as water. The second and third tanks may be utilized to rinse off the highly basic solvent 12 that may remain upon the permeable container 22 or upon any solid inorganic debris that may remain undigested. This may be accomplished by moving the permeable container 22 and/or solid debris sequentially through the tanks. Use of all three tanks is optional as use of either 1, 2, 3 or more tanks is possible. When only two tanks are utilized, it is preferable for the second tank to contain a solution having a pH of approximately 7, such as water.

It is also necessary to provide a means for moving the container 42 together with the animal tissue therein. The means necessary to complete this function is highly dependent upon the amount of animal remains a researcher intends to dispose of on a regular basis. If it is to be done in small amounts and, therefore small weights are involved, a less sophisticated or complex means could be used. An example being by man power. It is well known in the art today that there exists a multitude of ways and means to move heavy or bulky objects. Possibilities range from a simple winch and pulley systems to more mechanized apparatus such as forklifts, hydraulic apparatus, or mechanized winches. All that is required is that it be capable of moving the permeable container 22 in and out of a tank 34 and sequentially from tank 34 to tank 36 if more than one tank is used. It is also preferable that the moving means 42 be sized such that it can move the containers from tank 34 to tank 36 with a hood 26 remaining in place over the tanks.

A further component of the apparatus may include a freezer 40. This component is optional depending upon the needs of the particular researcher. When it is necessary to store the animal tissue for a period of time before disposing of the animal tissue a freezer may become necessary.

Although the invention has been described in the terms of the preferred embodiments, it is apparent to those skilled in the art that various modifications, substitutions, equivalents and other changes may be utilized without departing from the spirit of the invention. The specific examples and ranges were given merely as a guide and in no way were intended to limit the breadth of the invention. Any such modifications are intended to be within the scope of the invention as defined by the following claims.

Having thus described the invention, what is claimed is:

1. A method for producing a safely disposable solution from animal tissue containing radioactive materials comprising the steps of:

providing a highly basic solvent;

heating said highly basic solvent;

immersing said animal tissue containing radioactive materials in said highly basic solvent;

allowing said animal tissue to remain within said highly basic solvent until substantially digested; and forming a solution containing a substantially de minimis concentration of radioactive materials.

2. The method according to claim 1 wherein said highly basic solvent is provided within a sealable tank; and further comprising the step of sealing said tank after immersing said animal tissue containing radioactive materials within said highly basic solvent.

3. A method according to claim 1 wherein the forming of said solution containing a substantially de minimis concentration of radioactive materials further includes the step of further diluting said de minimis solution by the addition of water.

4. A method according to claim 2 wherein the forming of said solution containing a substantially de minimis concentration of radioactive material further includes the step of further diluting said de minimis solution by the addition of water.

5. The method according to claims 1 or 2 or 3 or 4 wherein said highly basic solvent comprises water and an alkali metal hydroxide or an alkali-earth metal hydroxide.

6. The method according to claims 1 or 2 or 3 or 4 wherein said highly basic solvent is water and an alkali metal hydroxide.

7. The method according to claims 1 or 2 or 3 or 4 wherein said highly basic solvent is water and an alkali metal hydroxide selected from NaOH and KOH.

8. The method according to claims 1 or 2 or 3 or 4 wherein said highly basic solvent is approximately 4%–10% percent of sodium hydroxide.

9. The method according to claims 1 or 2 or 3 or 4 wherein said highly basic solvent has a pH of at least about 13.

10. The method according to claims 1 or 2 or 3 or 4 wherein said highly basic solvent additionally comprises ethylenediamine tetraacetic acid (EDTA).

11. The method according to claims 1 or 2 or 3 or 4 wherein said highly basic solvent additionally comprises detergents.

12. The method according to claims 1 or 2 or 3 or 4 further comprising the step of agitating said animal tissue within said highly basic solvent.

13. The method according to claims 1 or 2 or 3 or 4 further comprising the step of circulating said highly basic solvent.

14. The method according to claims 1 or 2 or 3 or 4 further comprising the step of removing solid debris from said de minimis solution.

15. A method according to claims 1 or 2 or 3 or 4 further comprising the step of disposing said de minimis solution into a disposal means.

16. The method according to claim 15 wherein said disposal means comprises a sanitary sewer system.

17. The method according to claim 15 wherein said disposal means comprises a septic tank.

18. The method according to claims 2 or 3 or 4 further comprising increasing the pressure within said sealed tank above 1 atmosphere.

19. The method according to claims 1 or 2 or 3 or 4 further comprising the step of freezing the animal tissue containing radioactive materials prior to immersing into said highly basic solvent.

* * * * *